US005111954A

United States Patent [19]

Gaudreault

[11] Patent Number: 5,111,954

[45] Date of Patent: May 12, 1992

[54] TAMPER EVIDENT CONTAINER

[75] Inventor: Mario Gaudreault, St-Damien, Canada

[73] Assignee: IPL Inc.

[21] Appl. No.: 591,775

[22] Filed: Oct. 2, 1990

[51] Int. Cl.[5] ..... B65D 41/32

[52] U.S. Cl. ..... 220/266; 220/94 A; 220/214; 220/260; 220/306; 206/519

[58] Field of Search ..... 220/265, 266, 268, 306, 220/657, 659, 94 A, 270, 214, 260; 206/515, 518, 519

[56] References Cited

U.S. PATENT DOCUMENTS

| | | | |
|---|---|---|---|
| 3,811,597 | 5/1974 | Frankenberg et al. | 220/94 A X |
| 4,185,747 | 1/1980 | Goncalves . | |
| 4,209,101 | 6/1980 | Brown . | |
| 4,231,486 | 11/1980 | Bock . | |
| 4,293,073 | 10/1981 | Yates, Jr. | 206/519 |
| 4,296,871 | 10/1981 | Andersson | 220/306 |
| 4,347,940 | 9/1982 | Boik et al. . | |
| 4,361,244 | 11/1982 | Walter . | |
| 4,362,253 | 12/1982 | Wortley et al. . | |
| 4,393,978 | 7/1983 | Kessler et al. . | |
| 4,420,089 | 12/1983 | Walker et al. . | |
| 4,422,559 | 12/1983 | Landis | 220/306 |
| 4,438,864 | 3/1984 | Helms . | |
| 4,458,820 | 7/1984 | Abrams . | |
| 4,494,663 | 1/1985 | Bertaud et al. . | |
| 4,509,654 | 4/1985 | Maguire . | |
| 4,522,308 | 6/1985 | Sullivan . | |
| 4,572,385 | 2/1986 | Luker . | |
| 4,602,718 | 7/1986 | Dutt . | |
| 4,640,427 | 2/1987 | Marino et al. . | |
| 4,646,926 | 3/1987 | Agbay et al. . | |
| 4,711,364 | 12/1987 | Letica | 220/276 |
| 4,722,449 | 2/1988 | Dubach . | |
| 4,724,972 | 2/1988 | Marcus . | |
| 4,752,013 | 6/1988 | Miller et al. . | |
| 4,763,732 | 8/1988 | Neal | 169/51 |
| 4,779,764 | 10/1988 | Debetencourt . | |
| 4,782,964 | 11/1988 | Poore et al. . | |
| 4,787,530 | 11/1988 | Edwards | 220/266 |
| 4,795,044 | 1/1989 | Beck . | |
| 4,796,771 | 1/1989 | Stettler . | |
| 4,821,910 | 4/1989 | Poirier | 220/266 |
| 4,860,907 | 8/1989 | Sondal . | |
| 4,883,193 | 11/1989 | Christensson . | |
| 4,934,554 | 6/1990 | Edwards | 220/266 |
| 4,998,622 | 3/1991 | Drack | 206/519 |
| 5,027,969 | 7/1991 | Lesquir | 220/270 |

FOREIGN PATENT DOCUMENTS

| | | | |
|---|---|---|---|
| 85118 | 2/1956 | Denmark | 220/266 |
| 2416170 | 10/1979 | France | 220/266 |
| 720135 | 12/1954 | United Kingdom | 206/519 |

*Primary Examiner*—Stephen Marcus
*Assistant Examiner*—Stephen Cronin
*Attorney, Agent, or Firm*—Longacre & White

[57] ABSTRACT

The disclosure herein describes a container adapted to securely engage a cover displaying a peripheral depending skirt; it comprises a body with side walls having an upper edge portion adapted to engage the skirt of the closure. The side walls include a peripheral inverted L-shaped flange. Integrally formed with the flange is a pair of handles each including a frangible tab which must be broken to remove the cover from the container; however, the broken tabs do not hinder the reclosure of the container, nor the handling of the container. The handles are so shaped as to allow similarly constructed containers to be nested one into the other.

6 Claims, 3 Drawing Sheets

TAMPER EVIDENT CONTAINER

FIELD OF THE INVENTION

The invention relates to a container adapted to securely engage a cover and equipped with frangible tabs, the breaking of which will indicate that the closed container has been tampered with and, also, will allow the cover to be easily lifted from the container.

BACKGROUND OF THE INVENTION

Containers having a tamper-proof feature have become an important item of commerce. Generally, these tamper-proof assemblies comprise a cover with a tab attached to one part of the assembly by a breakable web. Often, the tab is broken simply by the act of opening the container, i.e. removing the cover. One such assembly may be found described in U.S. Pat. No. 4,362,253 issued Dec. 7, 1982 to Wortley et al.

OBJECTS AND STATEMENT OF THE INVENTION

It is an object of the present invention to provide, on a container which is adapted to securely engage a cover, an integrally formed side wall flange including frangible tab means which must be broken in order to have access to the cover's peripheral edge in order to remove or lift the cover from the container.

A close relationship is defined between the flange and the depending skirt of the cover thus rendering difficult the insertion of fingers or prying tools between the skirt and the flange for lifting the cover from the container. Authorized removal of the cover from the container is accomplished by breaking the tab means on the flange to subsequently facilitate the manual grasping of the skirt's lower edge and subsequently disengage the cover from the container.

The present invention therefore relates to a container adapted to securely engage a cover displaying a peripheral dependent skirt which comprises:

- a body including side walls having an upper edge portion adapted to engage the peripheral depending skirt of the cover; the side walls include a peripheral flange consisting of a horizontal portion projecting outwardly from the side wall and of an outer vertical portion distanced from the side wall; these portions receive in close relationship therewithin a lower part of the skirt; and
- tab means having a horizontal portion integrally formed with the side wall and with the horizontal portion of the flange, and a downwardly extending vertical portion integrally formed with the vertical portion of the flange; the horizontal and vertical portions of the tab means are connected to the horizontal and vertical portions of the flange through weakened areas to thereby render the tab means breakable when pressure is applied thereon, thus providing visual indication of tampering, whether authorized or unauthorized, and allowing removal of the cover from the container.

In one form of the invention, the tab means are part of handles integrally formed with the container.

In another form of the invention, the handles are constructed in a manner that similarly constructed containers can be nested one into the other. The lower edges of the handles are thus shaped with recessed areas to respectively receive the flange and the upper portion of the container wall.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 2:
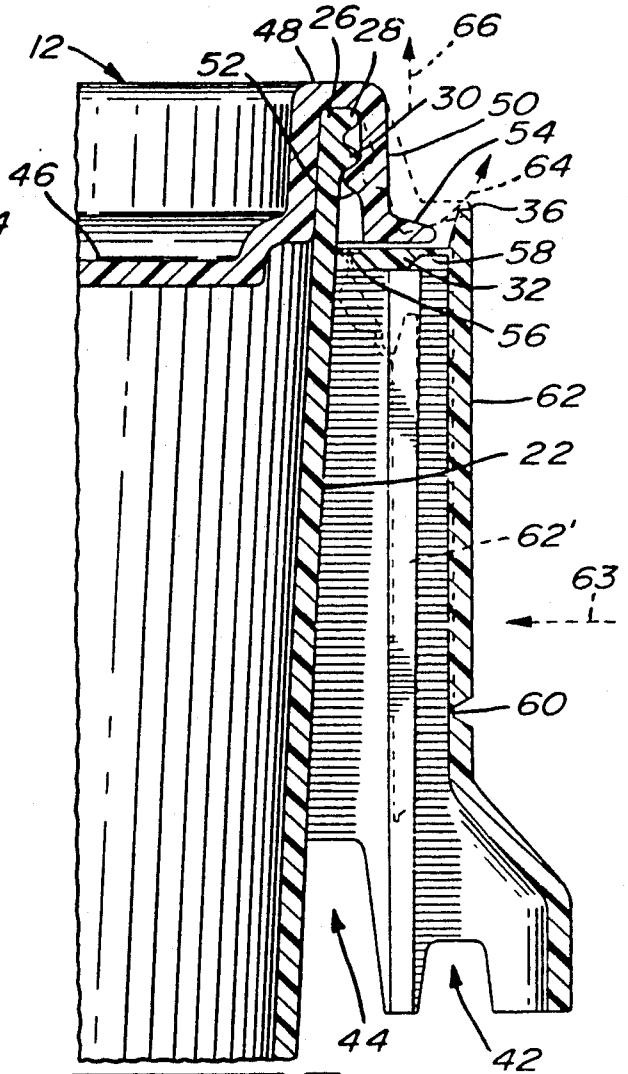
FIG. 2 is a cross-sectional view taken along lines 2—2 of FIG. 1.
Figure 1:
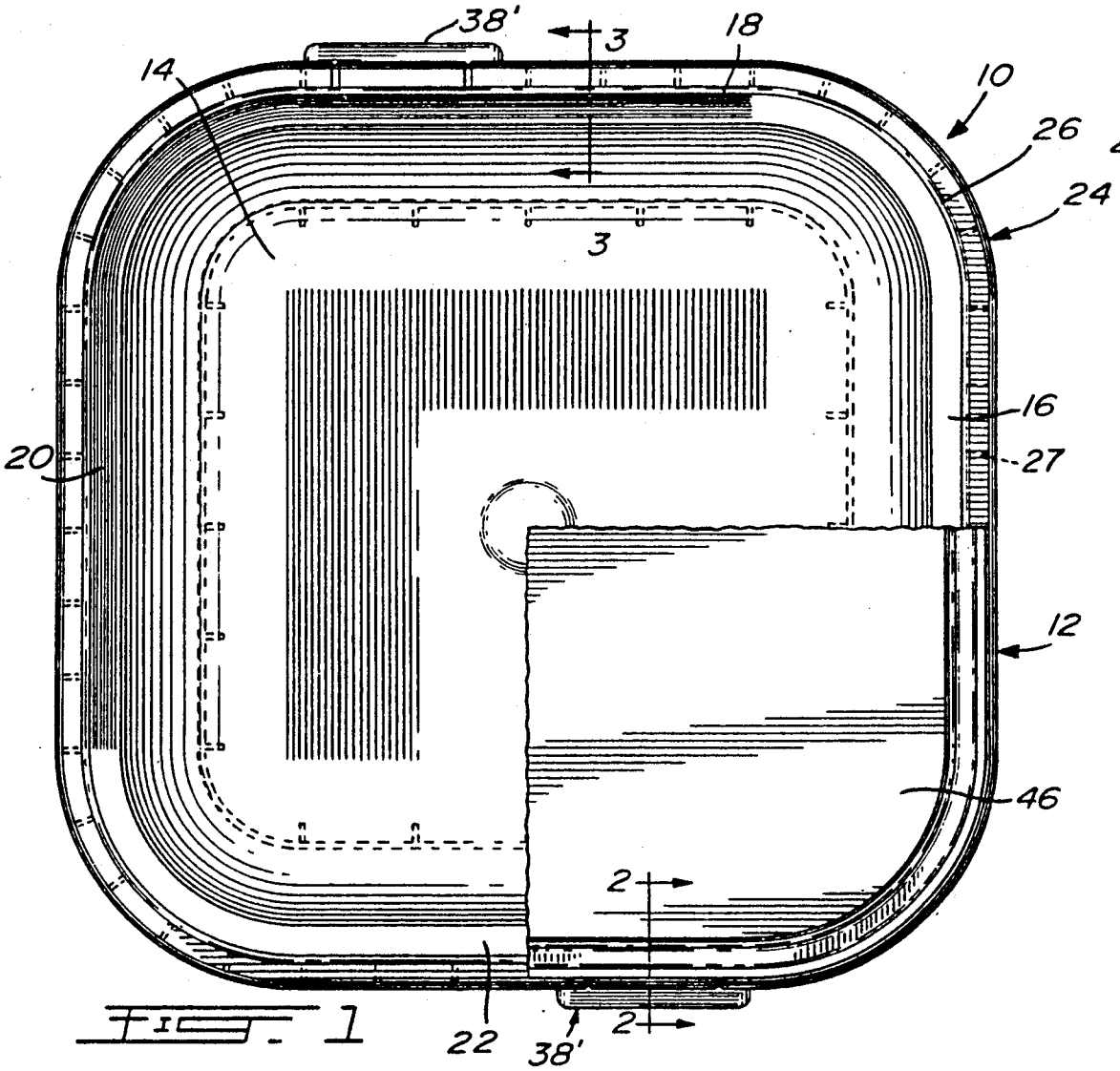
FIG. 1 is a top plan view of a container made in accordance with the present invention showing part of a cover thereon.

Referring to FIG. 1, there is shown a container, generally denoted 10, adapted to securely engage a cover, generally denoted 12. The container has a bottom wall 14 and four slightly inclined side walls 16, 18, 20 and 22. The four side walls display a continuous peripheral flange, generally denoted 24, having an inverted L-shape and disposed slightly lower than the upper edge portion 26 of the side wall. The flange is integrally formed with the side walls and includes peripherally spaced triangular shaped reinforcing ribs 27 therebeneath. As illustrated in FIG. 2, the peripheral upper edge portion 26 of the side walls displays a pair of vertically spaced circumferential beads 28 and 30.

Figure 3:
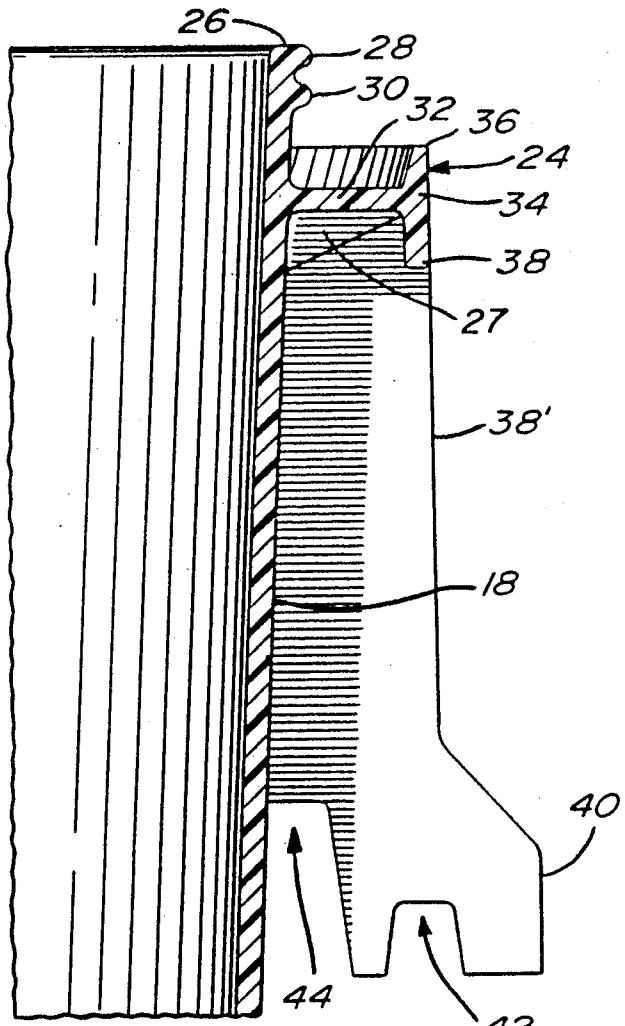
FIG. 3 is a cross-sectional view taken along lines 3—3 of FIG. 1.
Figure 4:
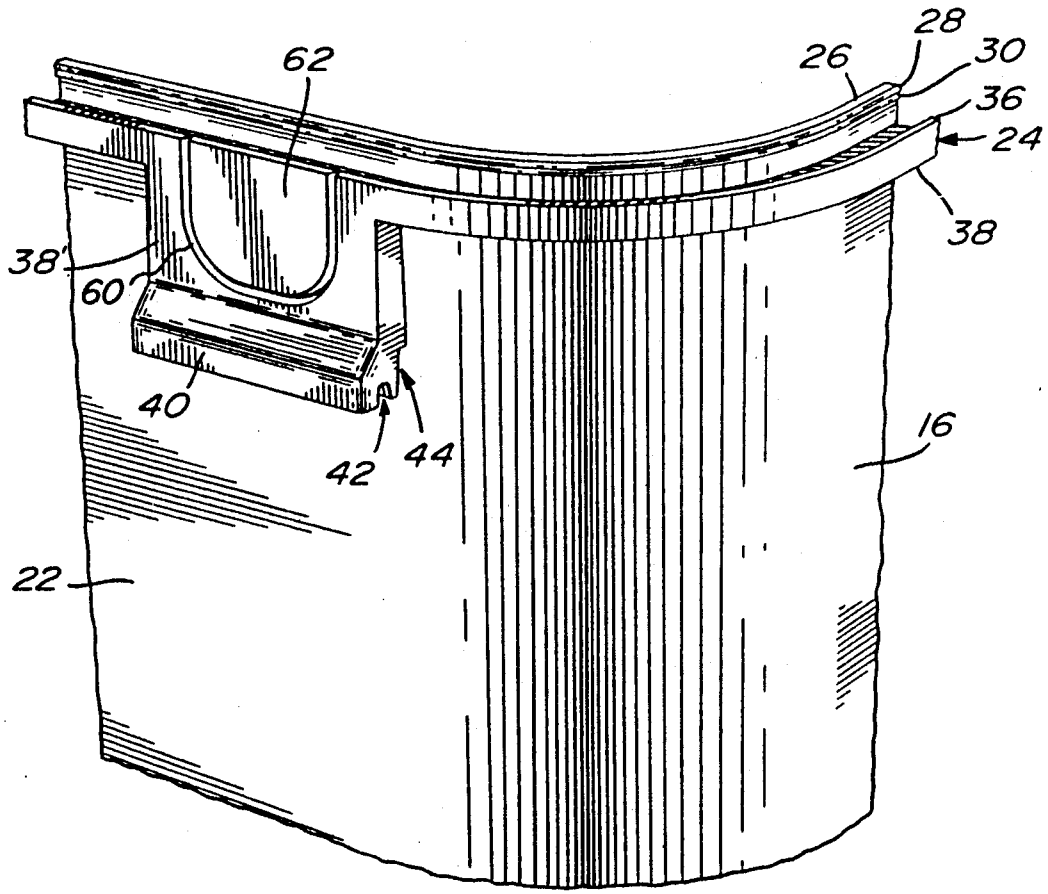
FIG. 4 is a perspective view showing one corner area of the container of the present invention.
Figure 5:
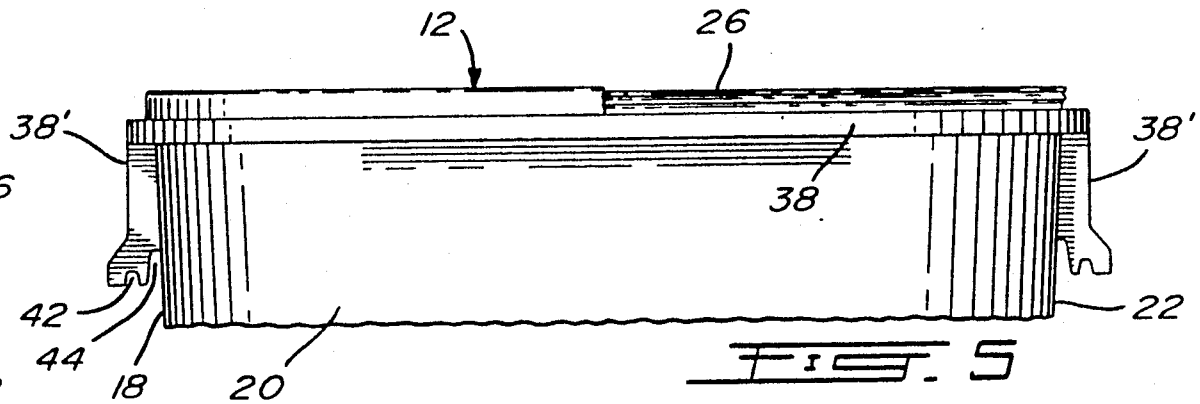
FIG. 5 is a side elevational view showing the upper part of the container with the partly broken-away cover thereon.

Referring to FIGS. 2, 3 and 4, the peripheral flange 24 consists of a horizontal portion 32 having one end integral with the side wall of the container and the opposite end terminating in a vertical portion 34 displaying an upper extension 36 and a lower extension 38.

On two opposite sides of the container, the flange 24 has downwardly extending enlarged areas 38' defining handles. As can be seen in FIG. 4, these handles have a general rectangular shape with a frontwardly projecting lower portion 40, the lower edge of which displays, on the opposite narrow sides thereof, a pair of recessed areas 42 and 44, the function of which will be described hereinbelow. The outer recessed area 42 is in vertical alignment with the upper portion 36 of the flange while the inner recessed area 44 is in vertical alignment with the upper edge portion 26 of the container.

As shown in FIGS. 1 and 2, the cover 12 has a flat central surface 46 and an inverted U-shaped peripheral edge 48 displaying a depending skirt 50 having a circumferential inner bead 52 and a flat outwardly projecting lower edge 54. This lower edge is confined within the recessed area defined by the upper edge portion 26, the horizontal portion 32 of the flange and the upper vertical extension 36. The material of the cover is preferably an injection moulded plastic so that the skirt 50 may be somewhat flexed to be forced into snap engagement with the peripheral upper edge portion 26 of the container with bead 52 engaging underneath bead 30.

In the handle area of the flange, the horizontal portion has a first line of reduced thickness, such as illustrated at 56, in order to make the material frangible along that line (horizontal portion 32 has also a further line 58 of reduced thickness to render the material bendable). Similarly, the front face of the handle has a U-shaped outline 60 of reduced thickness, thus defining a tab 62 (see FIG. 4).

As illustrated in FIG. 2, to remove the cover securely engaged with the container, one must press on the tab 62 in the direction of arrow 63 to force it inwardly within the cavity defined behind the handle, as shown by dotted lines 62'. In this position, the lower edge 54 of the cover skirt may be manually grasped to be lifted in the direction of arrow 64 to remove the cover, as illustrated by arrow 66.

It is recognized that it may be possible to insert a prying tool between edge 54 and the flange (on side wall 20 for example) to remove carefully the cover without breaking the tabs. However, this is extremely difficult due to the close confinement of the skirt edge 54 rearwardly of the flange's upper portion 36.

Figure 6:
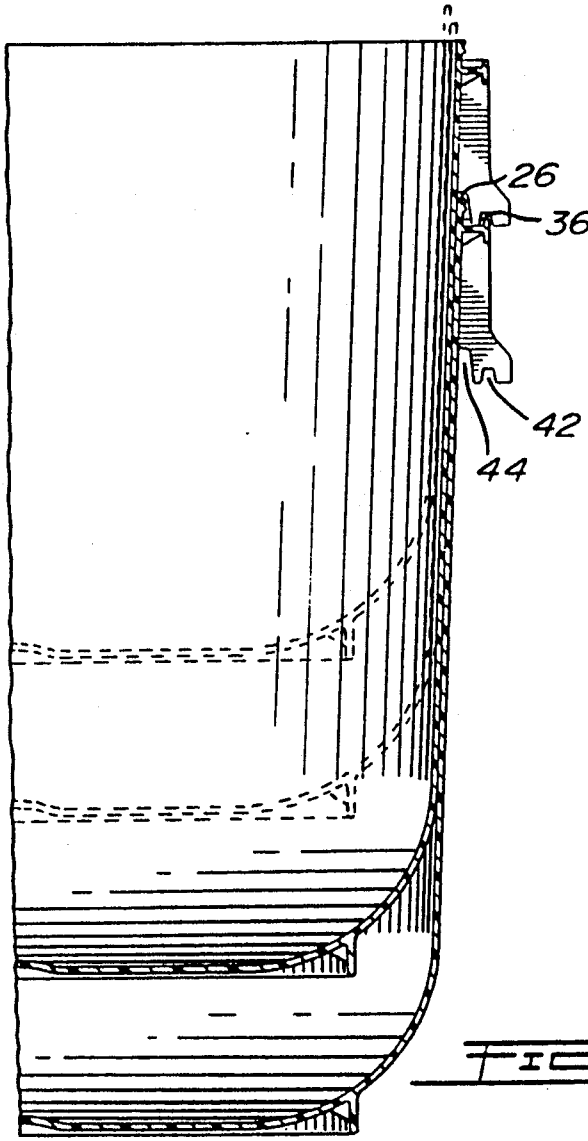
FIG. 6 is a partial cross-sectional view of similarly constructed containers made in accordance with the present invention in a nested engagement.

Referring to FIG. 6, two similarly constructed containers made in accordance with the present invention are shown to illustrate the function of recesses 42 and 44 which are adapted to respectively receive the upper portion 36 of the flange and the upper portion 26 of the container's side wall. Hence, nested containers are supported by the two handles 38' on the opposite sides of the container, and not on the inner faces of the side walls of the container.

Preferably, the container of the present invention is made of an injection moulded plastic material.

Although the invention has been described above with respect with one specific form, it will be evident to a person skilled in the art that it may be modified and refined in various ways. For example, the lines of reduced thickness may be formed of a series of aligned openings or gaps thus providing the same frangible effect to the tabs. It is therefore wished to have it understood that the present invention should not be limited in scope, except by the terms of the following claims.

The embodiments of the invention in which an exclusive property or privilege is claimed are defined as follows:

1. A container adapted to securely engage a cover displaying a peripheral depending skirt, comprising:

a body including side walls having an upper edge portion adapted to engage the peripheral depending skirt of a cover; said side walls including a peripheral flange consisting of a horizontal portion projecting outwardly from said side wall and of an outer vertical portion distanced from said side wall, said portions adapted to receive in close relationship therewithin a lower part of the skirt; and tab means having a horizontal portion integrally formed with said side wall and with said horizontal portion of said flange and a downwardly extending vertical portion integrally formed with said vertical portion of said flange; said horizontal and vertical portions of said tab means being connected to said horizontal and vertical portions of said flange through weakened areas to thereby render said tab means breakable when pressure is applied thereon thus providing visual indication of tampering, whether authorized or unauthorized, and adapted to allow removal of the cover from the container;

wherein said downwardly extending vertical portion of said tab means includes an enlarged area relative to said vertical portion of said flange thus defining a handle for said container; said tab means being provided in said enlarged area;

wherein said container defines four slightly inclined walls, said handle being provided on each of two opposite side walls of said container.

2. A container as defined in claim 1, wherein said weakened areas are reduced thicknesses in the material of said body and define a U-shaped outline in said enlarged area.

3. A container as defined in claim 1, wherein said container is formed of an injection-moulded plastic material.

4. A container adapted to securely engage a cover displaying a peripheral depending skirt, comprising:

a body including side walls having an upper edge portion adapted to engage the peripheral depending skirt of a cover; said side walls including a peripheral flange consisting of a horizontal portion projecting outwardly from said side wall and of an outer vertical portion distanced from said side wall, said portions adapted to receive in close relationship therewithin a lower part of the skirt; and tab means having a horizontal portion integrally formed with said side wall and with said horizontal portion of said flange and a downwardly extending vertical portion integrally formed with said vertical portion of said flange; said horizontal and vertical portions of said tab means being connected to said horizontal and vertical portions of said flange through weakened areas to thereby render said tab means breakable when pressure is applied thereon thus providing visual indication of tampering, whether authorized or unauthorized, and adapted to allow removal of the cover from the container;

wherein said downwardly extending vertical portion of said tab means includes an enlarged area relative to said vertical portion of said flange thus defining a handle for said container; said tab means being provided in said enlarged area;

wherein said enlarged area includes an outwardly projecting lower portion displaying recessed areas along lower edges thereof; said recessed areas including an outer recessed area in vertical alignment with said outer vertical portion of said flange to thereby receive therein an upper portion of the outer vertical portion of a flange of a lower similarly constructed container in which said container is adapted to be nested.

5. A container as defined in claim 4, wherein said recessed areas include an inner recessed area in vertical alignment with the upper edge portion of the inclined side wall of the container to thereby receive therein the upper edge portion of the side wall of a similarly constructed container in which said container is adapted to be nested.

6. A container as defined in claim 5, wherein the upper edge portion of said container contains external circumferential bead means adapted to be securely engaged with internal circumferential bead means on the skirt of the cover.

* * * * *